US011482354B2

(12) United States Patent
Yang et al.

(10) Patent No.: US 11,482,354 B2
(45) Date of Patent: Oct. 25, 2022

(54) THERMAL PROTECTION DEVICE

(71) Applicant: TDK Electronics AG, Munich (DE)

(72) Inventors: Wen Yang, Zhuhai (CN); Xiaojia Tian, Zhuhai (CN); Zhouquan He, Zhuhai (CN); Yongde Huang, Zhuhai (CN)

(73) Assignee: TDK ELECTRONICS AG, Munich (DE)

( * ) Notice: Subject to any disclaimer, the term of this patent is extended or adjusted under 35 U.S.C. 154(b) by 115 days.

(21) Appl. No.: 16/979,428

(22) PCT Filed: Apr. 3, 2019

(86) PCT No.: PCT/EP2019/058413
§ 371 (c)(1),
(2) Date: Sep. 9, 2020

(87) PCT Pub. No.: WO2019/193059
PCT Pub. Date: Oct. 10, 2019

(65) Prior Publication Data

US 2021/0005360 A1 Jan. 7, 2021

(30) Foreign Application Priority Data

Apr. 4, 2018 (CN) ..... 201810299514.X

(51) Int. Cl.
*H01C 1/08* (2006.01)
*H01C 1/144* (2006.01)
(Continued)

(52) U.S. Cl.
CPC ..... *H01C 1/08* (2013.01); *H01C 1/144* (2013.01); *H01C 7/12* (2013.01); *H01H 9/32* (2013.01)

(58) Field of Classification Search
CPC . H01C 1/144; H01C 1/08; H01C 7/12; H01C 7/126; H01H 9/32; H01H 9/0066;
(Continued)

(56) References Cited

U.S. PATENT DOCUMENTS 3,852,539 A * 12/1974 De Luca ..... H04M 1/745 361/124
5,708,553 A 1/1998 Hung
(Continued)

FOREIGN PATENT DOCUMENTS

CN 101834434 A 9/2010
CN 203026939 U 6/2013
(Continued)

*Primary Examiner* — Kevin J Comber
(74) *Attorney, Agent, or Firm* — Slater Matsil, LLP

(57) ABSTRACT

In an embodiment a thermal protection device includes a housing, a varistor partly embedded in the housing, wherein the housing electrically insulates the varistor, and wherein the varistor includes a partly uninsulated contact surface, an inner wall of insulating material arranged adjacent to the contact surface of the varistor, a window in the inner wall configured to allow an electrical connection of the contact surface of the varistor in an operational state of the thermal protection device and a moveable insulation block configured to cover the window in the inner wall to insulate the varistor in a region of the window of the inner wall in a fault state of the thermal protection device.

12 Claims, 3 Drawing Sheets

(51) Int. Cl.
*H01C 7/12* (2006.01)
*H01H 9/32* (2006.01)

(58) Field of Classification Search
CPC .. H01H 9/16; H01H 37/761; H01H 2037/763; H01T 1/12; H01T 1/14
USPC ..... 361/1
See application file for complete search history.

(56) References Cited

U.S. PATENT DOCUMENTS

| | | | | |
|---|---|---|---|---|
| 6,430,019 | B1 | 8/2002 | Martenson et al. | |
| 9,570,260 | B2 * | 2/2017 | Yang | H01H 61/02 |
| 2017/0110279 | A1 * | 4/2017 | Yang | H01H 37/761 |
| 2019/0027282 | A1 * | 1/2019 | Sun | H01H 85/2045 |
| 2020/0279701 | A1 * | 9/2020 | Yang | H01H 37/761 |

FOREIGN PATENT DOCUMENTS

| | | | | |
|---|---|---|---|---|
| CN | 103620703 | A | 3/2014 | |
| CN | 107946007 | A | 4/2018 | |
| EP | 867896 | A1 * | 9/1998 | H01C 7/12 |
| EP | 2537164 | A2 | 12/2012 | |
| JP | H08250304 | A | 9/1996 | |
| JP | 2008028089 | A | 2/2008 | |
| JP | 2009218508 | A | 9/2009 | |
| KR | 200462103 | Y1 | 8/2012 | |
| WO | 2013034769 | A1 | 3/2013 | |
| WO | 2017139912 | A1 | 8/2017 | |
| WO | 2017140463 | A1 | 8/2017 | |

* cited by examiner

THERMAL PROTECTION DEVICE

This patent application is a national phase filing under section 371 of PCT/EP2019/058413, filed Apr. 3, 2019, which claims the priority of Chinese patent application 201810299514.X, filed Apr. 4, 2018, each of which is incorporated herein by reference in its entirety.

TECHNICAL FIELD

The invention concerns a thermal protection device to protect a varistor against overheating.

BACKGROUND

A varistor has a special current-voltage characteristic. The varistor changes from an electrically insulating state to an electrically conductive state if an applied voltage exceeds a certain value. This effect is used to protect voltage-sensitive electrical elements. However, if the varistor becomes conductive, a high current can flow through it. The current can heat up the varistor to a point of explosion or other damage.

To protect the varistor and other electrical elements against such overheating one may use thermal protection as described in U.S. Pat. No. 6,430,019 B1. One type of such protection is a thermal fuse.

SUMMARY

Embodiments provide a fast and reliable thermal protection device. Further embodiments provide a thermal protection device to protect a varistor in cases of overheating due to a persistently high voltage applied to the varistor for a certain time.

Embodiments relate to a thermal protection device comprising a housing defining at least one cavity. In the housing a varistor is partly embedded. If a voltage applied to the varistor reaches a characteristic value, the varistor changes from an electrically insulating state to an electrically conductive state and allows a flow of a high current. The varistor comprises a contact surface on one side. Furthermore the housing comprises an inner wall of insulating material, which is placed adjacent to the varistor and to the contact surface of the varistor. There is a window provided in the inner wall, which allows a connection to the contact surface of the varistor during an operational state of the thermal protection device. In a fault state of the thermal protection device, the window in the inner wall is covered by a moveable insulation block. Thereby, the contact surface of the varistor would be completely electrically insulated by the covered window and the inner wall.

The operational state is the state of the thermal protection device as long as a system, where the thermal protection device is installed, is in an ordinary state. If a high voltage is applied to the varistor due to an error in the system, the varistor becomes electrically conductive. As a result a high current flows through the thermal protection device. This current can heat up the varistor and the electrical connection to it. The thermal protection device is designed to protect the varistor against such a heating up. Therefore the electrically conductive connection between the varistor and the system gets interrupted by the thermal protection device in the case of a heating up. The case of the interruption of the connection is the fault state of the thermal protection device.

The moveable insulation block is arranged inside the housing. The function of the moveable insulation block is to insulate the varistor in a region of the window during a fault state of the thermal protection device.

Such a housing provides optimal protection for any inner parts against environmental influences, e.g., humidity or dust. The inner wall on the contact surface of the varistor with the window in it defines a small contact area on the contact surface, which is easier to control by the thermal protection device compared to an open contact surface. In the operational state the thermal protection device allows a connection to the contact surface of the varistor. Due to the reduction of useable contact area of the varistor, it is easier to reduce the risk of electric arcs. The covering of the window in the inner wall of the housing is a safe disconnection, since the whole contact surface would be electrically insulated. Furthermore, the cover can be designed to prevent an electric arc, which would elude the provisions of the thermal protection device.

In an embodiment the thermal protection device is designed with a varistor comprising a second contact surface with a terminal. This contact surface with the terminal can be arranged on an opposite side to the first contact surface of the varistor mentioned above. The terminal on the second contact surface can be larger than the dimensions of the varistor. In a special modification the terminal on the second contact surface can protrude from the housing. The terminal protruding from the housing can be formed so as to plug the varistor on a circuit board. Thereby the housing and also the thermal protection device can be plugged on a circuit board via the terminal. The varistor can be a metal oxide varistor. In a certain modification it would be a zinc oxide varistor. The varistor can have a rectangular shape but is not limited to it. The varistor may also have a round shape, for example. The possible terminal protruding from the housing with the possibility to be plugged can improve the handling and exchanging of the thermal protection device. This would allow an easy and quick replacement.

Another embodiment of the thermal protection device comprises a metal contact formed to a terminal. This metal contact can define a spring terminal. The spring terminal would be fixed to the housing. It can be partly arranged in the cavity of the housing. During the operational state of the thermal protection device one end of the spring terminal can be connected to the first contact surface of the varistor through the window in the inner wall of the housing inside the cavity. Such a connection can cause a pre-stress in the fixated spring terminal which would cause a spring force directed away from the connection perpendicular to the first contact surface of the varistor. The possible pre-stress in the spring terminal during the operational state of the thermal protection device can lead to a shorter response time in the case of triggering. Additionally, the spring terminal would not revert to its initial position of connection to the first contact surface of the varistor without an external force after triggering of the thermal protection device. A part of the spring terminal can protrude from the housing. This part can be designed as a pluggable terminal. Therefore, it can provide a stably plugged thermal protection device.

In an embodiment of the thermal protection device, the connection between the spring terminal and the first contact surface of the varistor is implemented as a low temperature solder joint during the operational state of the thermal protection device. Therein "low temperature" can be a characteristic temperature at which the solder joint would reach a state where it would allow a separation of the before-connected metal contact and the contact surface due to a force or pre-stress as it could exist in the metal contact. It is possible that the "low temperature" is the melting temperature of the low temperature solder. This characteristic temperature would be called "low" because of its possibly lower value compared to a usual characteristic temperature of solder. The characteristic temperature of the low temperature solder can be in a range from 100° C. to 210° C., e.g., 138° C. If the low temperature solder joint is heated up to the characteristic temperature, the connection can become loose and the solder can become liquid. If the connection between the spring terminal and the first contact surface becomes loose, a separation of the two becomes easy. Such a separation would lead to a fault state of the thermal protection device. Therein the term "fault" is chosen due to the origin of the state, which is a fault in the system in which the thermal protection device is installed.

In this embodiment heating of the low temperature solder joint can be caused either by a high current which flows through the connection as a consequence of the fault in the system or by the heat radiated from the varistor itself since the solder joint is in direct contact with the varistor. Additionally, the heating of the low temperature solder joint can be caused by any other source from outside the thermal protection device. A high current or a heated varistor are the cases against which the thermal protection device should protect the varistor. The arrangement of the low temperature solder joint can ensure a short response time of the thermal protection device.

A possible combination of an embodiment with a low temperature solder joint with the spring terminal from the embodiment above can lead to a safe and fast disconnection of the first contact surface of the varistor, due to the arrangement of the connection close to the varistor and the stress in the connected spring terminal.

In a further embodiment of the invention, the housing is closed by a removable plastic cap. The removable plastic cap would allow access to the parts in the cavity of the housing. Furthermore, with an accurate application of heat it can be possible to rebuild the low temperature solder joint between the spring terminal and the first contact surface after triggering of the thermal protection device. This would allow a skilled person to reset the thermal protection device to an operational state.

Another embodiment of the thermal protection device comprises a spring in the cavity of the housing. The spring can be a torsion spring. The spring can be arranged adjacent to the inner wall of the housing opposite to the varistor. Furthermore the thermal protection device of this embodiment can comprise a moveable insulation block inside the cavity of the housing adjacent to the inner wall. Specifically, the moveable insulation block can be partly located between the spring terminal and the inner wall. Both the spring and the moveable insulation block or only one of them can have a common centre of rotation. At this centre of rotation a rivet would be arranged on the inner wall that reaches in the cavity of the housing. On the rivet both the spring and the moveable insulation block can be fixated.

In the operational state of the thermal protection device the spring can push the moveable insulation block against the spring terminal, which is connected to the first contact surface of the varistor. The moveable insulation block pushed by the spring can represent a source of force acting on the connection between the spring terminal and the first contact surface of the varistor, wherein the force performed by the spring and the moveable insulation block would be directed parallel to the inner wall. The force can be directed to separate the spring terminal from the first contact surface of the varistor in a fault state of the thermal protection device.

Since the spring terminal can be already pre-stressed in an operational state of the thermal protection device, the moveable insulation block in combination with the described spring force represents a further separation mechanism. Such a further separation mechanism in the form of the moveable insulation block pushed by a spring would increase the safety of the thermal protection device since it ensures a separation of the connection to the first contact surface if the connection gets loose.

Since the moveable insulation block can be designed to move in a rotation around a rivet in the centre of rotation, no guide rails are needed. Therefore it is unlikely for the moveable insulation block to jam. This would improve the safety of the thermal protection device.

In a preferred embodiment of the thermal protection device the moveable insulation block as described above can be pushed in an end position by the spring in the case of a fault state of the thermal protection device. Such a fault state can be reached if the connection to the first contact surface of the varistor becomes loose due to a heating up of the varistor. The moveable insulation block can be designed to separate a terminal from the first contact surface of the varistor. Furthermore it can be designed to cover the window in the inner wall of the housing, as a result of which the first contact surface of the varistor would be completely electrically insulated and therefore defy electric arcs. Such a design would ensure the disconnection of the varistor and prevent an emergency of a flashover in a fault state of the thermal protection device.

A possible embodiment of the thermal protection device comprises an indicator to signal the current state of the thermal protection device. The indicator would be partly arranged in the housing and can comprise signal contacts which protrude from the housing and an indicator trigger which is arranged in the housing. The indicator may be a micro-switch. It is also possible that the moveable insulation block reaches the trigger of the indicator in a fault state of the thermal protection device. The moveable insulation block can be designed to trigger the indicator if it is pushed in the end position of the moveable insulation block. It is possible that any further electronic be connected to the signal contacts of the indicator to display the state of the thermal protection device.

DETAILED DESCRIPTION OF ILLUSTRATIVE EMBODIMENTS

Figure 1:
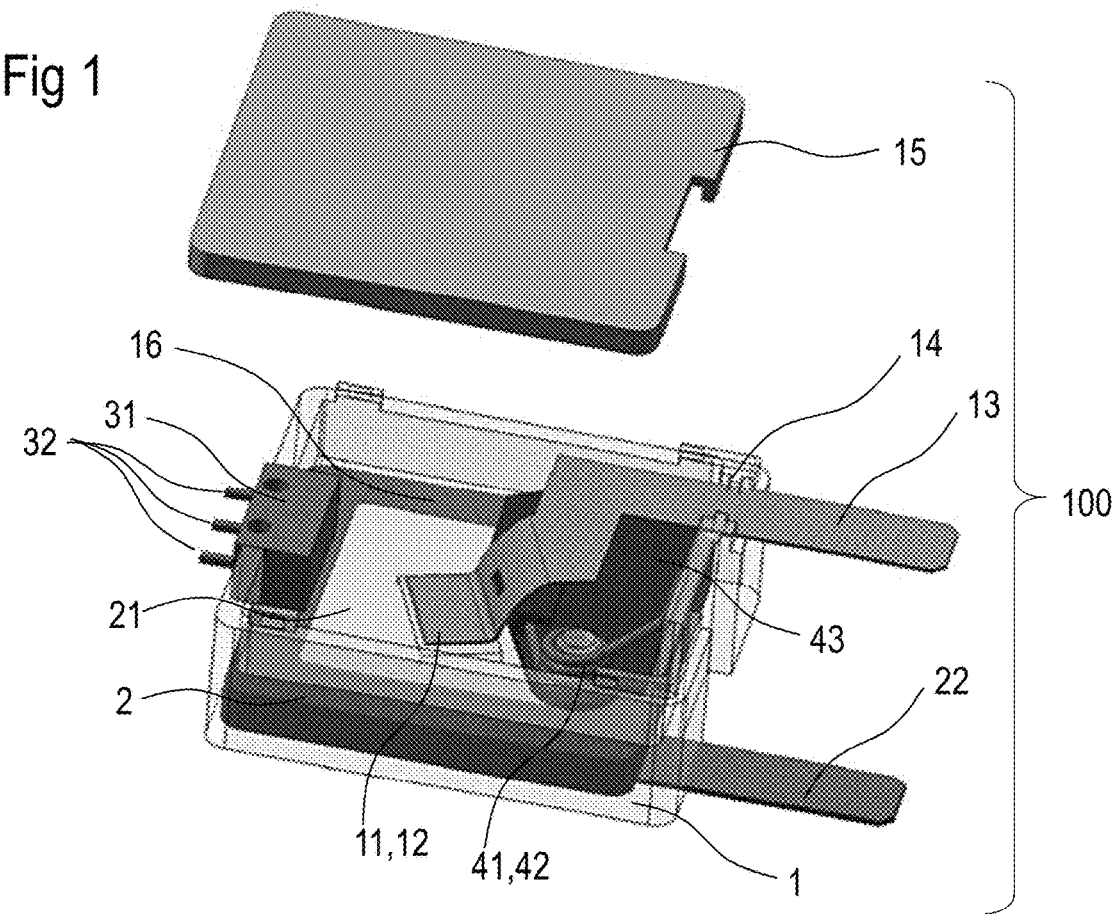
FIG. 1 shows a schematic perspective representation of a thermal protection device. Here the housing is transparent.

FIG. 1 shows an exemplary embodiment of a thermal protection device 100 in an operational state. In the figure a housing 1 is represented as transparent to bring a varistor 2 into view, which is partly embedded in the housing 1. The housing 1 comprises an inner wall 16, which is arranged parallel to a contact surface 21 of the varistor 2. The housing defines at least one cavity. Here, the inner wall 16 can also be a wall of the cavity mentioned before. The inner wall 16 comprises a window 12, which offers the possibility for forming a connection from a part in the cavity to the contact surface 21 of the varistor 2. The varistor 2 comprises a terminal 22. Said terminal is arranged on an opposite side of the contact surface 21 and protrudes from the housing 1.

The thermal protection device 100 comprises a spring terminal 13, which is partly arranged in the cavity of the housing 1. The spring terminal is held in its position by a fixation feature 14 in the housing 1. The protruding parts of the spring terminal 13 and of the terminal 22 of the varistor 2 are designed to make the thermal protection device pluggable. During the operational state of the thermal protection device 100 an end of the spring terminal 13 in the cavity of the housing 1 is connected to the contact surface 21 of the varistor 2 through the window 12 in the inner wall 16 of the housing 1. The connection between the spring terminal 13 and the first contact surface causes a stress in the spring terminal, which is directed away from the contact surface 21 of the varistor 2. To hold the connection between the spring terminal 13 and the contact surface 21, an electrical connection 11 is used. The electrical connection 11 is realised by a low temperature solder joint. Such a low temperature solder joint has a critical temperature at which the solder becomes liquid. The critical temperature at which the solder becomes liquid can be in a range between 100° C. and 210° C., e.g., 138° C.

The shown embodiment of the thermal protection device 100 in an operational state comprises a moveable insulation block 43, which is arranged in the cavity of the housing 1 and abuts on the inner wall 16. A spring 42 is placed in the cavity and pushes the moveable insulation block 43 against the spring terminal 13 near the electrical connection 11. The spring 42 is held in place by a feature to fix the spring 41, which is arranged on the inner wall 16 and reaches into the cavity of the housing 1. The path of movement for the moveable insulation block 43 and the spring 42 is a path of gyration with its centre at the feature 41 to fix the spring 42, in a plane parallel to the inner wall 16 and therefore parallel to the contact surface 21 of the varistor 2.

The embodiment of the thermal protection device comprises an indicator 31, as shown in FIG. 1. The indicator 31 is partly arranged in the housing 1 and can be reached by the moveable insulation block 43. The indicator comprises signal contacts 32, which are arranged outside the housing 1.

Figure 2:
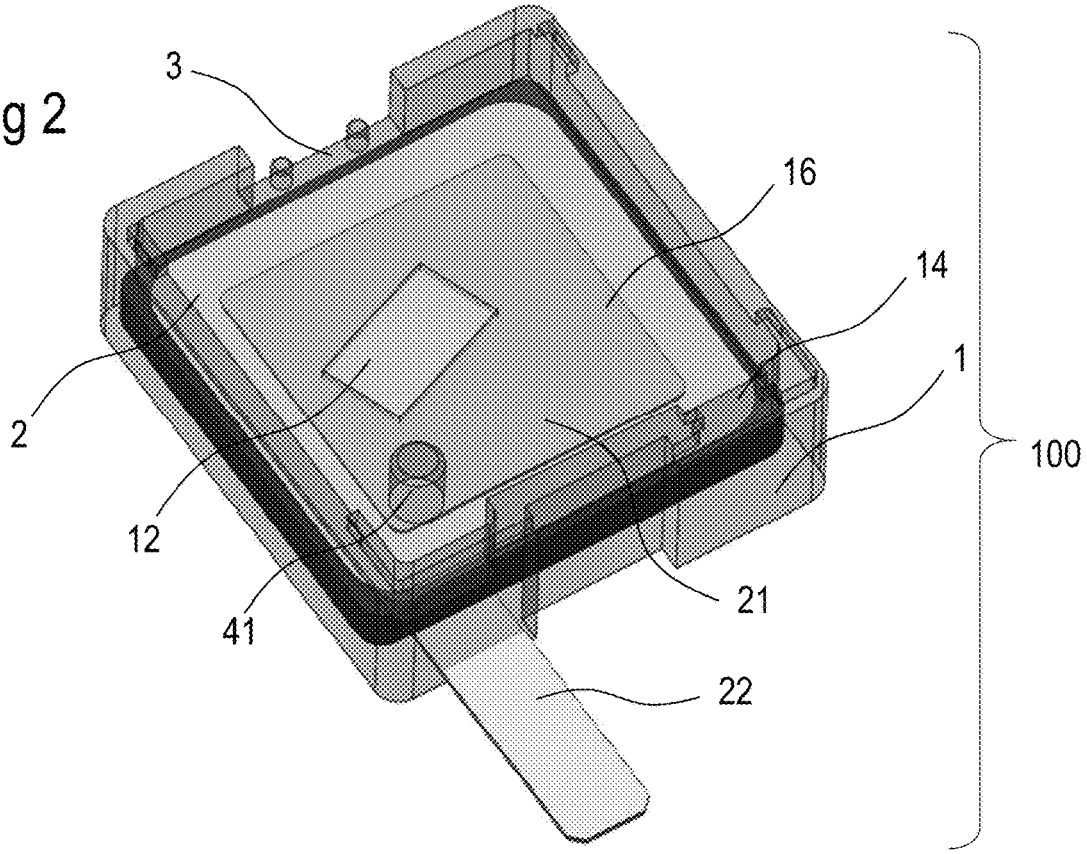
FIG. 2 shows a transparent housing to bring the embedded varistor into view.

FIG. 2 shows an embodiment of the housing 1 for a thermal protection device in a transparent view to show the partly embedded varistor 2. The shown embodiment of the housing comprises the inner wall 16 with the window 12, wherein the inner wall 16 is arranged parallel to the contact surface 21 of the partly embedded varistor 2 and delimits a cavity in the housing 1. The window 12 in the inner wall 16 allows a connection to be formed to the contact surface 21 of the varistor 2. The shape or arrangement of the window 12 within the inner wall 16 is not limited to the example shown in the figures. The terminal 22 of the varistor 2 is located on an opposite side of the contact surface 21 and protrudes from the housing 1.

In the housing 1 there is a feature 3 to fix the indicator 31. This feature 3 is a notch in the outer wall of the housing, which reaches from an upper boundary of the housing to the level of the inner wall 16. The housing 1 comprises the feature 14 to fixate a spring terminal. The feature 14 also is a notch in the outer wall of the housing 1.

In the cavity of the housing there is the feature 41 to fix the spring 42. The feature 41 to fix the spring 42 is designed like a rivet which is arranged on the inner wall 16 and reaches into the cavity of the housing 1.

Figure 3:
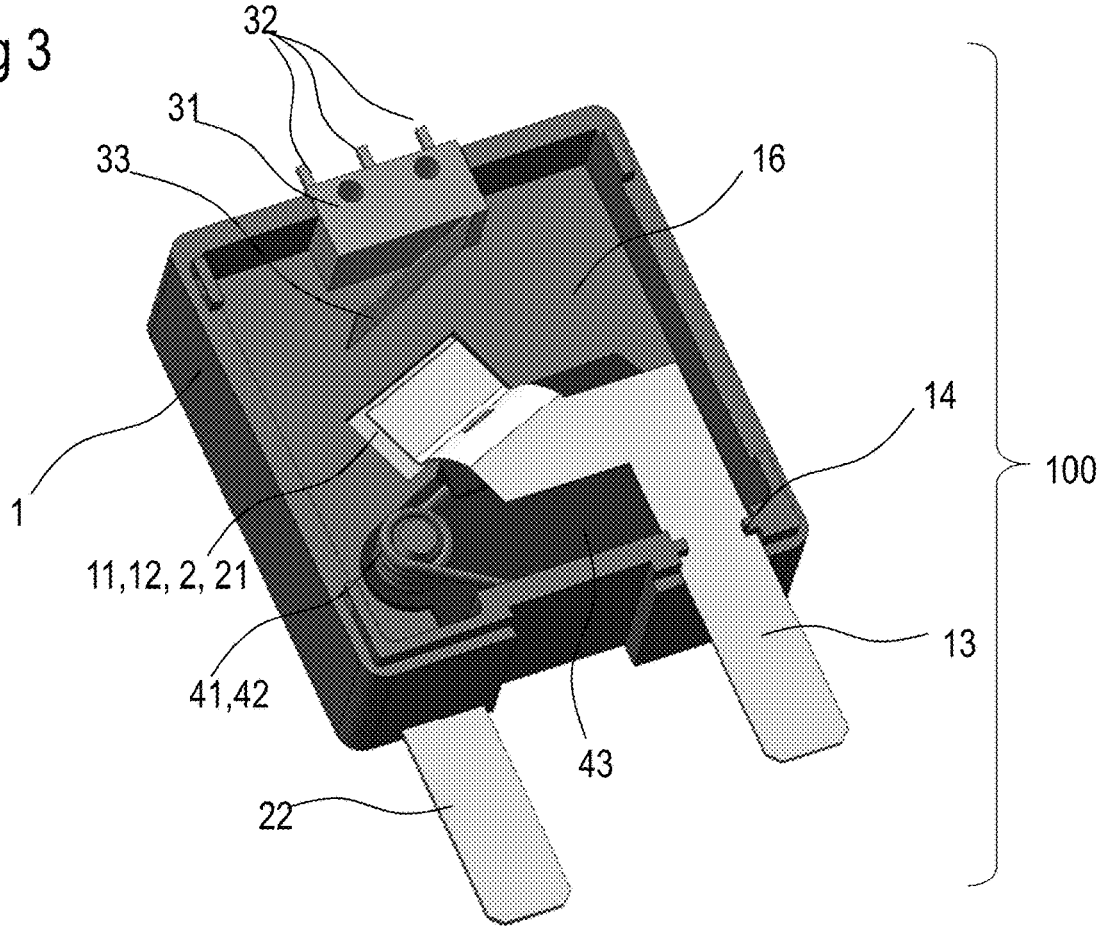
FIG. 3 represents a thermal protection device in an operational state.

FIG. 3 represents a schematic overview of a possible embodiment of the thermal protection device 100 in an operational state. In this operational state the spring terminal 13 is connected to the contact surface 21 of the varistor 2, which is partly embedded in a cavity of the housing 1. The connection is realised through the window 12 in the inner wall 16 of the housing 1 and is held by means of the electrical connection 11. The solder joint is stable at low temperatures and the low temperature solder stays solid until its temperature reaches a critical temperature. The spring terminal 13 is fixed at the housing 1 via the feature 14 to fix the spring terminal partly in the cavity of the housing 1. Due to the fixation of the spring terminal 13 and the connection to the contact surface 21, a stress is built up in the spring terminal near the end which is connected to the contact surface 21 of the varistor 2. This stress is directed away from the contact surface and causes a fast separation of the spring terminal 13 and the contact surface 21 of the varistor 2, if the low temperature solder becomes liquid.

In this embodiment the thermal protection device 100 comprises the moveable insulation block 43. During the operational state the moveable insulation block 43 is arranged between the inner wall 16 and the spring terminal 13 inside the cavity of the housing 1. The spring 42 pushes the moveable insulation block 43 against the spring terminal 13 near the electrical connection 11 as long as the thermal protection device 100 is in its operational state. The spring 42 and the moveable insulation block 43 have a common rotation axis. This rotation axis is defined by the feature 41 to fix the spring 42, which is arranged on the inner wall 16 an reaches into the cavity of the housing 1. The torsion spring has two arms, wherein one arm is to push the moveable insulation block 43 and the other arm is pushed against a wall of the housing 1 in order to provide a torque in the spring 42.

Inside the cavity of the housing a trigger 33 of the indicator 31 is arranged. During the operational state of the thermal protection device 100, the trigger 33 of the indicator 31 is not activated. A corresponding electrical signal can be tapped at the signal contacts 32 of the indicator 31, which protrude from the housing 1.

Figure 4:
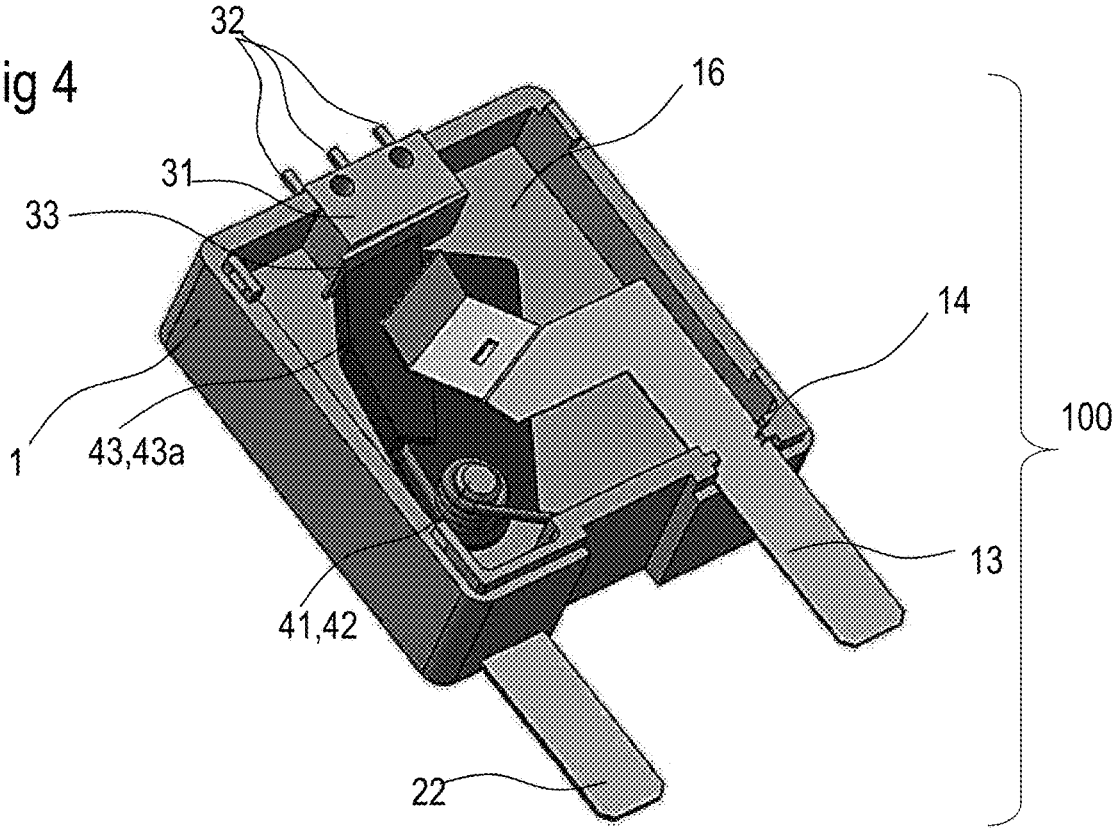
FIG. 4 represents a thermal protection device in a fault state.

FIG. 4 shows a schematic overview of a possible embodiment of the thermal protection device 100 in a fault state. The fault state is a result of a chain reaction, initiated by a critically high voltage between the spring terminal 13 and the terminal 22 of the varistor over a certain time. If the voltage between these terminals reaches a characteristic value, the varistor 2 changes from an electrically insulating state to an electrically conductive state and allows a high current as a first result. The high current can heat up the electrical connection 11 between the spring terminal 13 and the contact surface 21 of the varistor 2. That would liquefy the used low temperature solder. Thereby the electrical connection 11 becomes loose either due to the stress in the spring terminal, which bends the spring terminal 13 away from the contact surface 21 of the varistor 2, or due to the torque of the spring 42, which pushes the moveable insulation block 43 between the spring terminal 13 and the inner wall 16, over the window 12. As a result of this chain reaction, the spring terminal 13 is separated from the varistor 2 and the moveable insulation block closes the window 12 in the inner wall and activates the trigger 33 of the indicator 31.

Figure 5:
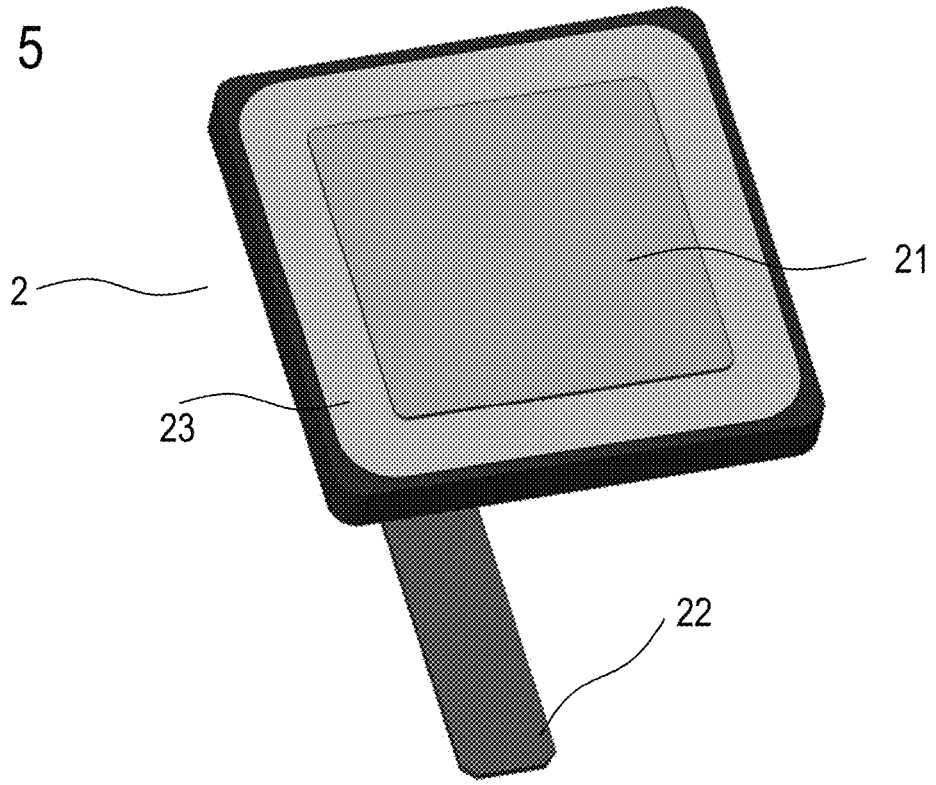
FIG. 5 represents a schematic view of a metal oxide varistor disc.

FIG. 5 shows an exemplary embodiment of the varistor 2. The varistor comprises the contact surface 21 on one side of the varistor 2. The contact surface 21 is arranged on a metallization layer 23 of the varistor 2. This metallization layer 23 can partly or completely extend over one side of the varistor 2. The varistor 2 comprises a further contact surface with the terminal 22 on the opposite side with respect to the contact surface 21. The terminal 22 of the varistor 2 protrudes over the dimensions of the varistor 2. In a possible embodiment, the terminal 22 is designed in such a way that it reaches out of the housing 1. The varistor can be designed as a metal-oxide varistor. Such a metal-oxide varistor has a characteristic electrical behavior if a voltage is applied between the two contact surfaces. If the applied voltage reaches a certain value, the varistor resistance changes rapidly from an insulating state to a conductive state.

The invention claimed is:

1. A thermal protection device comprising:

a housing;

a varistor partly embedded in the housing, wherein the housing electrically insulates the varistor, and wherein the varistor comprises a partly uninsulated contact surface;

an inner wall of insulating material arranged adjacent to the contact surface of the varistor;

a window in the inner wall configured to allow an electrical connection of the contact surface of the varistor in an operational state of the thermal protection device;

a moveable insulation block configured to cover the window in the inner wall to insulate the varistor in a region of the window of the inner wall in a fault state of the thermal protection device, wherein the moveable insulation block is configured to move in a rotation around a rivet in a center of rotation;

a metal contact defining a spring terminal such that the spring terminal is electrically connected through the window to the contact surface of the varistor during the operational state of the thermal protection device; and an indicator configured to signal a current state of the thermal protection device, wherein the indicator comprises an indicator trigger, and wherein the moveable insulation block is configured to press the indicator trigger when the moveable insulation block is moved in its end position in the fault state of the thermal protection device thereby operating the indicator trigger of the indicator.

2. The thermal protection device of claim 1, wherein the metal contact is subject to a pre-stress acting in a direction away from the contact surface during the operational state of the thermal protection device.

3. The thermal protection device of claim 1, wherein the electrical connection between the contact surface of the varistor and the spring terminal comprises a low temperature solder joint during the operational state of the thermal protection device, and wherein a low temperature is a characteristic temperature at which the solder joint reaches a state where it allows a pre-stress to interrupt a contact with the contact surface.

4. The thermal protection device of claim 3, wherein the characteristic temperature is a melting temperature of a solder, and wherein the melting temperature is in a range from 180° C. to 210° C.

5. The thermal protection device of claim 1, wherein the moveable insulation block is pressed against the spring terminal by a spring force from a spring during the operational state of the thermal protection device.

6. The thermal protection device according to claim 1, wherein the moveable insulation block is configured to be pushed in an end position by a spring and to thereby cover the window of the inner wall in the fault state of the thermal protection device.

7. The thermal protection device according to claim 1, wherein the housing comprises the indicator on a front side such that signal contacts of the indicator reach out of the housing and the indicator trigger reaches into the housing.

8. The thermal protection device according to claim 7, wherein the indicator is a micro-switch.

9. The thermal protection device according to claim 7, wherein the moveable insulation block is configured to be pushed in its end position by a spring thereby operating the indicator trigger of the indicator in the fault state of the thermal protection device.

10. The thermal protection device according to claim 1, wherein the varistor has a rectangular shape or a round shape.

11. The thermal protection device according to claim 1, wherein the varistor comprises a second contact surface provided with a terminal.

12. A thermal protection device comprising:

a housing;

a varistor partly embedded in the housing, wherein the housing electrically insulates the varistor, and wherein the varistor comprises a partly uninsulated contact surface;

an inner wall of insulating material arranged adjacent to the contact surface of the varistor;

a window in the inner wall configured to allow an electrical connection of the contact surface of the varistor in an operational state of the thermal protection device;

a moveable insulation block configured to cover the window in the inner wall to insulate the varistor in a region of the window of the inner wall in a fault state of the thermal protection device; and an indicator configured to signal a current state of the thermal protection device, wherein the indicator comprises an indicator trigger, wherein the moveable insulation block is configured to press the indicator trigger when the moveable insulation block is moved in its end position in the fault state of the thermal protection device thereby operating the indicator trigger of the indicator, and wherein the thermal protection device is configured such that, with an accurate application of heat, a low temperature solder joint between a spring terminal and the contact surface is rebuildable after triggering of the thermal protection device so that the thermal protection device is resettable to the operational stats.

* * * * *